US005315109A

United States Patent [19]

Thomas

[11] Patent Number: 5,315,109

[45] Date of Patent: May 24, 1994

[54] POSITION MEASUREMENT OF MOVING ATOMS USING OPTICAL FIELDS

[75] Inventor: John E. Thomas, Chapel Hill, N.C.

[73] Assignee: Duke University, Durham, N.C.

[21] Appl. No.: 957,431

[22] Filed: Oct. 6, 1992

[51] Int. Cl.[5] ..... H05H 3/00

[52] U.S. Cl. ..... 250/251

[58] Field of Search ..... 250/251, 491.1

[56] References Cited

U.S. PATENT DOCUMENTS

| | | | |
|---|---|---|---|
| 4,454,482 | 6/1984 | DeMarchi | 250/251 |
| 4,797,552 | 1/1989 | Steel et al. | 250/251 |
| 5,043,574 | 8/1991 | Maier et al. | 250/251 |

OTHER PUBLICATIONS

V. Chebotayev et al., *J. Opt. Soc. Am.* 2, No. 11, 1791-1798 (1985).

M. Kasevich et al., *Phys. Rev. Letters* 66, 2297-2300 (1991).

P. Martin et al., *Phys. Rev. Letters* 60, No. 6, 515-518 (1988).

C. Salomon et al., *Phys. Rev. Letters* 59, No. 15, 1659-1662 (1987).

K. Stokes et al., *Phys. Rev. Letters* 67, No. 15, 1997-2000 (1991).

J. Thomas, *Phys. Rev. A* 42, No. 9, 5652-5666 (1990).

J. Thomas, *Optics Letters* 14, No. 21, 1186-1188 (1989).

*Primary Examiner*—Bruce C. Anderson

*Attorney, Agent, or Firm*—Bell, Seltzer, Park & Gibson

[57] ABSTRACT

Disclosed is a method and apparatus for precisely measuring the position of moving atoms in an atom beam. The method employs atomic resonance imaging in which a spatially varying potential correlates an atomic resonance frequency with the atomic position. The method comprises (a) emptying an atomic beams of all atoms in a predetermined detectable final state; (b) passing the atomic beam through a field which induces atoms in the beam to make a transition from the initial atomic state to the detectable final atomic state, while simultaneously providing a spatially varying potential and wherein the energy of the final atomic state of the atoms is dependent upon the position of the atoms in the spatially varying potential concurrent with the field; and (c) detecting the final atomic state of said atoms to generate a spectrum which corresponds to the position distribution of atoms in the atomic beam. Apparatus for implementing said method of measuring moving atoms is also disclosed.

20 Claims, 4 Drawing Sheets

POSITION MEASUREMENT OF MOVING ATOMS USING OPTICAL FIELDS

The present invention was made with Government support. The Government has certain rights to this invention.

FIELD OF THE INVENTION

The present invention relates to an optical method for measuring the precise position of moving atoms in atomic beams. The method can achieve suboptical wavelength spatial resolution and does not destroy the atomic beam being measured.

BACKGROUND OF THE INVENTION

Substantial progress has recently occurred in creating atomic distributions that vary over small length scales. In atomic beams, such distributions have been created by diffraction, periodic spatial modulation, channeling, focusing, and cooling. In general, the distributions exhibit momentum-space coherence and are of both practical and fundamental interest. Recently, techniques have been developed for precise velocity selection which are complementary to the techniques of the present invention. See. e.g., Kasevich et al., *Phys. Rev. Lett.* 66, 2297 (1991). Important applications include atomic interferometry, gyroscopes, and the creation of submicron structures by atomic deposition. See. e.g., Martin et al., *Phys. Rev. Lett* 60, 515 (1988); Chebotaev et al., *J. Opt. Soc. Am. B* 2, 1791 (1985).

While techniques exist to create suboptical wavelength atomic spatial modulation and interference in atomic beams, methods for detection have been limited principally to hot wires or mechanical slits, which are relatively crude devices. The only use of optical absorption to determine an atomic position distribution has been by channeling atoms in an off-resonant optical standing wave. See Salomon et al., *Phys. Rev. Lett.* 59, 1659 (1987).

Optical methods such as those disclosed in the instant application are ideally suited for high-resolution resonance imaging because they permit the study of very small volumes, which facilitates the application of large spatially varying potentials. Further, optical techniques do not require mechanical surfaces (wires, slits, electrodes, etc.) to be placed in the region to be studied and thus the atomic beam is not destroyed.

SUMMARY OF THE INVENTION

A first aspect of the present invention is a method of measuring the position of atoms in an atomic beam. The method comprises (a) emptying an atomic beam of atoms in a predetermined detectable final state; then (b) passing the atomic beam through a transition inducing oscillating field having a frequency which induces atoms in the beam to make a transition from the initial atomic state to said detectable final atomic state while simultaneously passing the atomic beam through a spatially varying potential wherein the energy of the final atomic state of the atoms is dependent upon the position of the atoms in said spatially varying potential; then (c) detecting the number of atoms in said detectable final state; and then (d) repeating steps (b) and (c) with said transition inducing field having a different frequency at each repetition of (b) and (c) to generate a spectrum which corresponds to the position distribution of atoms in the atomic beam.

The emptying step is performed by optical pumping. The spatially varying potential may be generated by two nonresonant intersecting linearly polarized laser fields. The spatially varying potential may alternatively be generated by a spatially varying magnetic field. The transition inducing field may comprise a Raman field or a single radio frequency field. The decting step may be a fluorescence detecting step, a photon burst detecting step or a photoionization detecting step.

The atomic beam, after measurement, may be deposited upon a substrate after said detecting step.

A second aspect of the present invention is an apparatus for implementing the method of measuring the position of atoms in an atomic beam. The emptying means comprises an optical pump. The means for generating a spatially varying potential can comprise two nonresonant intersecting linearly polarized laser fields or a spatially varying magnetic field. The means for generating a transition inducing field may comprise a Raman field or a single radio frequency. The detecting means may be fluorescence detecting means, photon burst detecting means or photoionization detecting means.

A third aspect of the present invention is an apparatus for measuring the position of atoms in an atomic beam, wherein said spatially varying potential comprises a nonresonant laser field that varies in intensity across the atomic beam. The emptying means comprises an optical pump. The means for generating a spatially varying potential comprises two nonresonant intersecting linearly polarized laser fields where the area of intersection encompasses the area to be measured. Said means for generating a spatially varying potential may include the use of a calcite wedge to create said intersecting laser fields or the use of at least one mirror to create said intersecting laser fields. The means for generating a spatially varying potential may comprise means for generating a focussed laser field by using a cylindrical lens. The means for generating a transition inducing field may comprise a Raman field or a single radio frequency. The detecting means is selected from the group consisting of fluorescence detection means, photon burst detection means and photoionization detection means.

BRIEF DESCRIPTION OF THE DRAWINGS

The invention will now be described further by way of example with reference to the accompanying figures in which.

DETAILED DESCRIPTION OF THE INVENTION

Figure 1:
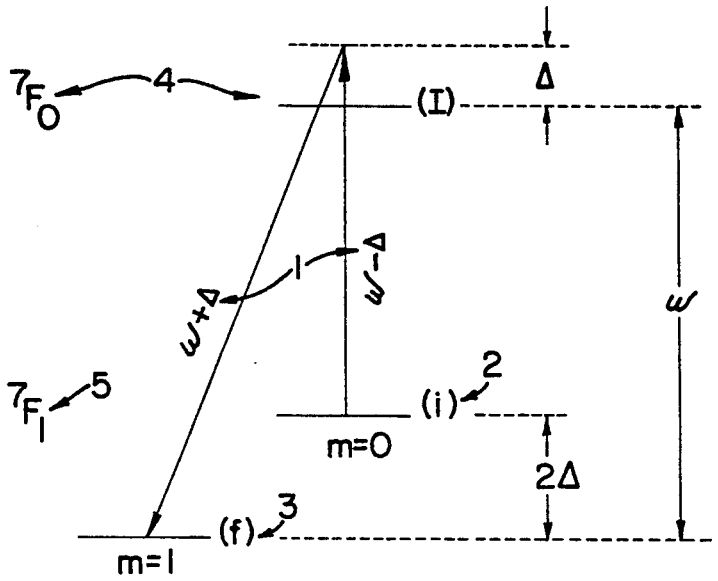
FIG. 1 is a schematic diagram of the energy levels of samarium ($^{152}Sm$) and the atomic transitions occurring in the present invention when the spatially varying potential is generated by a spatially varying magnetic field.

The present invention is directed to an atomic beam resonance imaging technique which is capable of high spatial resolution and which provides a general state-selective method for the position measurement and localization of moving atoms. The invention utilizes Raman induced or radio frequency induced resonance imaging techniques. The fundamental limits on spatial resolution for the instant resonance imaging method are determined by the interplay between maximizing spectral resolution and minimizing atomic motion along the measurement x axis, which is perpendicular to the atomic beam. In general, this atomic motion includes the velocity of the atoms along the measurement axis, acceleration imparted by the spatially varying potential, and wave mechanical diffraction. The best possible spatial resolution is achieved by choosing an optimum transit time across the optical field region. Transit-time-limited spectral resolution is achieved in the present invention by using optically induced Raman or radio frequency transitions between long-lived states. The combination of optimum spectral resolution with a large spatially varying potential maximizes spatial resolution. Appropriate configurations generally require that the size of the measurement region be quite small, which is readily accomplished in the present invention using focused laser fields to induce the Raman transitions. In the present invention radio frequencies can also be used to induce similar transitions with equivalent resolution.

An important feature of the present method is that the spatially varying potential affects only the final atomic state of an atomic transition, while the initial state is unaffected. This permits the initial state to propagate into the measurement region without perturbation. Assuming that the spatially varying potential varies linearly along the x axis only the final atomic state energy is shifted according to $$V(x) = -(x - x_0)F, \qquad \text{(Equation 1)}$$

where F is just the classical force exerted on the final state by the spatially varying potential and $x_0F$ is the shift from an adjustable, spatially constant field. The spatial resolution $\Delta x$ is determined by the spectral resolution $\Delta\omega$ according to $\Delta V = F\Delta x = h\Delta\omega$. With transit-time-limited resolution for the atomic transition, the spectral resolution is just $\Delta\omega = 1/T$, where T is the transit time across the transition inducing fields. Hence, $$\Delta x = h/FT. \qquad \text{(Equation 2)}$$

Using Equation (2), it is readily shown that the present resonance imaging method can yield uncertainty-principle-limited spatial resolution for highly collimated atomic beams where the transverse momentum $Mv_x < FT$. An atom can make a transition from the initial state into the final state at any time during the transit time T. Since the force only is applied to the final state, an atom making a transition initially upon entering the measurement region acquires a transverse momentum FT, while an atom making the transition just before leaving the measurement region acquires no transverse momentum. Thus, the momentum spread $\Delta p$ due to the applied potential is FT. In this case, according to Equation (2), atoms which make a transition to the final state emerge from the measurement region in a localized wave packet of width $\Delta x$ and with a momentum spread $\Delta p$ imparted by the spatially varying potential which obeys $\Delta x \Delta p = h$. Under certain conditions, a minimum-uncertainty Gaussian wave packet can be produced.

With less collimation, the spatial resolution is limited by the transverse thermal velocity spread. In this case, the best possible velocity-limited spatial resolution, $\Delta x_{vel}$, can be understood physically as follows. By increasing the transit time T, the spectral resolution is increased. However, during the time T an atom of transverse velocity $v_x$ will move along the x axis a distance $v_xT$. To achieve the optimum spatial resolution T must be limited to times of order $T = \Delta x_{vel}/v_x$. Using this as the maximum transit time in Equation (2) yields $\Delta x_{vel} = (hv_x/F)^{\frac{1}{2}}$. The corresponding diameter d of the measurement region for a supersonic beam of speed $v_y$ is just $v_yT \simeq \Delta x/\theta$, where $\theta$ is the beam collimation half angle.

Figure 2:
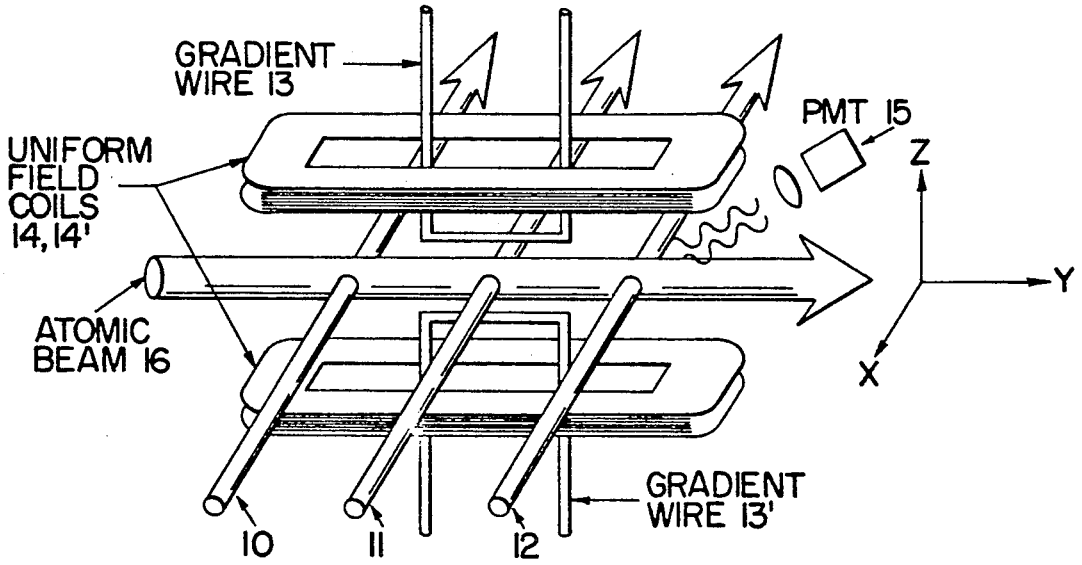
FIG. 2 is a diagram of an apparatus for carrying out a specific mode of the present invention using a spatially varying magnetic field to generate a spatially varying potential.

A more careful calculation yields velocity-limited resolution $$\Delta x_{vel} = (2hv_x/F)^{\frac{1}{2}}, \qquad \text{(Equation 3)}$$

which differs from the heuristic result by $\sqrt{2}$. In this calculation, the Raman laser fields or radio frequency fields are assumed to have Gaussian intensity distributions and the optimum intensity 1/e width is found to be $d = \Delta x_{vel}/\theta$. For Gaussian laser fields, the fluorescence signal S, measured in the final-state detection region can be shown to depend on the Wigner phase-space distribution for the initial atomic state, $\rho_i(v_x, x')$, according to $$S(x_0) \propto \eta_R \int dv_x dx' R_1(x' - x_0, v_x)\rho_i(v_x, x'), \qquad \text{(Equation 4)}$$

where $R_1$ is the spatial resolution function and $\eta_R$ is the transition probability for F=0 (FIGS. 1 and 2). In general the function $R_1$ has a complicated dependence on the velocity ($v_x$) and force (F), but for optimized velocity-spread-limited spatial resolution, $R_1$ takes the simple form $$R_1(x' - x_0, v_x) = \frac{1}{\sqrt{2}} \exp\left[-\frac{(x' - x_0)^2}{\Delta x_{vel}^2}\right] \qquad \text{(Equation 5)}$$

where it is assumed that the incident phase-space distribution is specified at the center of the measurement region. According to Equations (4) and (5), the spatial resolution given by Equation (3) determines the 1/e width of a Gaussian spatial resolution function which is convoluted with the incident phase-space distribution.

Either diode or dye lasers may be used in the present invention's transition inducing step, provided the laser frequency stability is adequate for the position resolution desired. The required stability for a given position resolution can be readily calculated from the formulas given in the present application.

In the present invention the spatially varying potential that functions to shift the energy of the final atomic state can be generated by a spatially varying magnetic field or by a nonresonant intense laser field. The intensity of the laser field required to generate the required spatially varying potential is calculated for the desired energy shift using formulas and principles well known in the art.

For modes of the present invention using a spatially varying nonresonant intense laser field, very high spatial resolution can be achieved when the difference between the energy of the final atomic state and the initial atomic state spatially varies in the range of from $F/h=10^{10}$ to $F/h=10^{13}$ Hz/cm. When using a spatially varying nonresonant intense laser field the optimum acceleration limited resolution is given by the formula:

$$\left[\frac{h^2}{2MF}\right]^{\frac{1}{3}}$$

For example, when $F/h=10^{12}$ Hz/cm, resolution achieved is 70 angstroms using samarium as the atomic system.

A nonresonant intense laser field can be generated by two linearly polarized laser fields that intersect in the atomic beam, yielding a spatially varying intensity. Additional methods of generating laser fields of spatially varying intensity include, but are not limited to, using mirrors to reflect laser fields such that they intersect; using a calcite wedge in laser transmission to create two intersecting laser beams; and using a cylindrical lens to create a focussed laser field. A calcite wedge can split a single laser field to create two intersecting laser fields at small angles of intersection, for example, 10–20 μm period for intensity variation can be achieved using a calcite wedge. Using a cylindrical lens 30 cm in focal length, for example, and a laser beam of from 1 cm to 1 mm in diameter creates a focal diameter along the measurement axis of the atom beam of from 1 to 100 μm.

EXAMPLE 1

Raman-induced Resonance Imaging in a Samarium Supersonic Beam

This example demonstrates an apparatus for the Raman-induced resonance imaging method in a samarium supersonic beam using the $^7F_1 \rightarrow {}^7F_0$ transition of $^{152}$Sm at 570.65 nm, as shown schematically in FIG. 1. Samarium was chosen for its convenient ground-state level structure, absence of nuclear spin, and convenient optical resonance frequency. As seen in FIG. 1, Raman fields of frequencies $\omega \pm \Delta$ (1) induce transitions between the initial state i (2) and final state f (3). A spatially varying potential interacts with the f→I transition to shift the final state f, making the Raman transition frequency position dependent. The excited electronic state I (4) of $^{152}$Sm is $^7F_0$, and $^7F_1$ (5) is the ground electronic state of $^{152}$Sm.

Atoms which are initially in the m=0 sublevel of the $^7F_1$ ground state make a Raman transition to the m=+1 sublevel via the $^7F_0$ excited state which serves as an off-resonant intermediate state. The m=+1 state, which is emptied prior to the Raman region by optical pumping, is detected after the Raman region by resonance fluorescence. A spatially varying magnetic field shifts the m=+1 state (g factor of 1.5), so that the resonance frequency of the Raman transition is dependent on the position of the incident atoms along the measurement x axis. Equations (4) and (5) assume that the difference frequency for the Raman fields is chosen to yield resonance at the point $x=x_0$. The point $x_0$ is readily shifted by tuning a uniform magnetic field. Detecting final-state fluorescence downstream from the Raman region versus uniform magnetic field determines the spatial distribution of atoms in the initial state with a resolution $\Delta x_{vel}$. Physically, the fluorescence intensity induced in the detection region from the m=+1 final state is proportional to the number of incident atoms in the m=0 state near the point on the x axis where the Raman fields are resonant with the local Raman transition frequency.

A diagram of the experimental apparatus used in this Example is shown in FIG. 2. The first laser beam (10) with frequency $\omega$ empties the final atomic state (f in FIG. 1). Atoms then enter the Raman region where two overlapping laser beams (11) of frequencies $\omega+\Delta$ and $\omega-\Delta$ cause transitions from the initial state (i in FIG. 1) to the final state in a localized region along the x axis. The spatially varying magnetic field used in this example consists of a linearly varying field with a constant gradient of 500 G/cm, plus a 100-G uniform magnetic field oriented along the z axis which shifts the m=+1 state by approximately 220 MHz. The gradient magnetic field is generated with two parallel copper tubes (13 and 13') separated by 6 mm and carrying 100 A each in the same direction. The uniform magnetic field is generated by two uniform field coils (14 and 14'). With the atomic beam axis defined as y, the magnetic-field gradients are $\partial B_z/\partial x=\partial B_x/\partial z=500$ G/cm. Because of the strong uniform field along the z axis, the spatially varying level shift of the m=+1 state is dominated by the linear variation of the z magnetic field along the x axis. This yields a linearly varying energy for the m=+1 state, and hence for the Raman transition, of $10^9$ Hz/cm along the x axis. Atoms in the atomic beam (16) which emerge in the final state are detected by laser induced fluorescence using an additional laser beam (12) and a photo multiplier tube (PMT) (15) in the final region.

Figure 3:
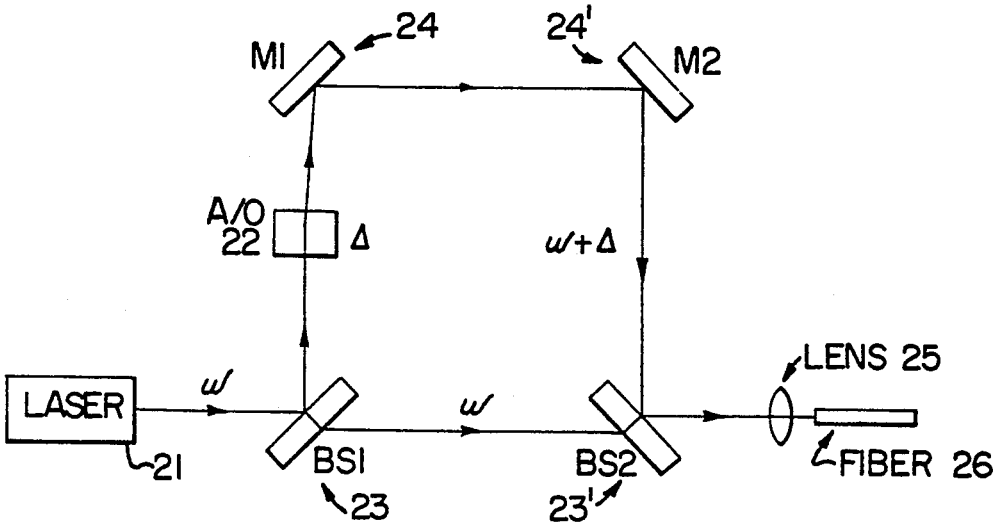
FIG. 3 is a diagram of an apparatus using acousto-optic modulation to obtain two mode matched optical fields with a stable difference frequency, used in the present invention to induce Raman transitions with high spectral resolution.

The two copropagating optical fields which induce the Raman transition are derived using acousto-optic frequency shifting of ±110 MHz from a single stable cw dye laser operating at 570.65 nm. FIG. 3 shows a schematic diagram of this method of obtaining two mode matched optical fields with a stable difference frequency (Δ) by acousto-optic modulation (A/O) to induce Raman transitions with high spectral resolution. The laser (21) can be any single mode source. Multiple A/O modulators can be used to create beams with any combination of frequencies (e.g., $\omega \pm \Delta$ as used in FIG. 1). In FIG. 3, a single A/O modulator (22) is used. The laser field is split and recombined using two beam splitters (23 and 23') and directed using mirrors (24 and 24').

The two beams are orthogonally polarized and focussed using a lens (25) and combined in a single-mode polarization-preserving optical fiber (26) to ensure good mode matching and parallel propagation of the Raman fields. The intensities of the off-resonant Raman fields are chosen so that the light shifts of the m=0 and m=+1 states are equal. Since the Raman resonance condition requires only that the difference frequency of the optical fields match the splitting between the initial and final states, dye-laser frequency jitter and unwanted Doppler frequency shifts due to the finite atomic and laser beam collimation are eliminated. Additionally, the excited-state spontaneous decay rate does not enter into the linewidth of the Raman transition. Hence, transit-time-limited spectral resolution is obtained.

The optimum spatial resolution in the present experiments can be estimated from the above discussion. Since V/h is the level shift of the final $m=+1$ state in Hz, in the present experiments $F/h=10^9$ Hz/cm. The supersonic speed of the samarium beam is found by time-of-flight measurements to be $v_y=9\times10^4$ cm/sec. For supersonic beams, the effective oven aperture due to collisions is larger than the actual oven aperture, making the collimation angle uncertain. The collimation half angle $\theta$ is estimated by measuring the Doppler width of a one photon transition after a 100-$\mu$m slit placed 10 cm from the oven aperture. This yields $\theta\simeq0.5$–1 mrad. For $\theta=1$ mrad, $v_x=90$ cm/sec, and Eq. (3) determines the optimum spatial resolution $\Delta x\simeq1.7$ $\mu$m. The corresponding optimum diameter (FWHM) of each of the Raman fields is 2.8 mm. With the gradient magnetic field turned off, this corresponds to a Raman linewidth (FWHM) of 210 kHz as is readily shown from the weak-field Raman line shape for Gaussian laser beams in the transit-time limit. These values were used in our experiment.

Experimental measurements of the Raman line shape with the gradient magnetic field off were obtained by monitoring fluorescence in the detection region versus uniform magnetic field. The measured linewidth of 200 kHz (FWHM) is in nearly exact agreement with that expected in the transit-time limit. Although the theoretical analysis assumes weak Raman fields, in practice it is convenient to increase the Raman laser intensities to increase the transition probability. In the optimum case, the Raman "pulse area" $\phi$ in the atom frame should be approximately ]. A strong-field theory of the Raman line shape for an off-resonant intermediate state (i.e., a two-level theory without decay) shows that no broadening of the line is expected provided that the ground-state light shifts induced by the Raman fields are equal and $\phi\simeq\pi$. The measured line shape taken for $\phi\simeq\pi$ confirms this result. Hence, in the position measurements, the Raman field intensities are left at the optimized levels.

For high spatial resolution with the gradient magnet on, the Raman laser beams must be focused and precisely centered along the vertical z axis between the two gradient magnet wires. This is due to the $\partial B_x/\partial z$ contribution to the $m=+1$ level shift which leads to a position smearing in our experiment given by 2.5 $cm^{-1}$, $(z^2)$. The vertical FWHM of the Raman beams is therefore focused to $\simeq75$ $\mu$m, which reduces the smearing below 0.4 $\mu$m. Precise centering is accomplished spectroscopically, by reversing the current in one of the parallel wires of the gradient magnet. Using this apparatus, the Raman linewidth with the gradient on is shown to narrow dramatically when the Raman beams are precisely centered with respect to the gradient wires compared to when they are not centered.

EXAMPLE 2

Measurement of the Shadow of a 25-$\mu$m Diameter Wire

This example demonstrates the precision of the invention by measuring a known diameter, using the apparatus described in Example 1.

Figure 4:
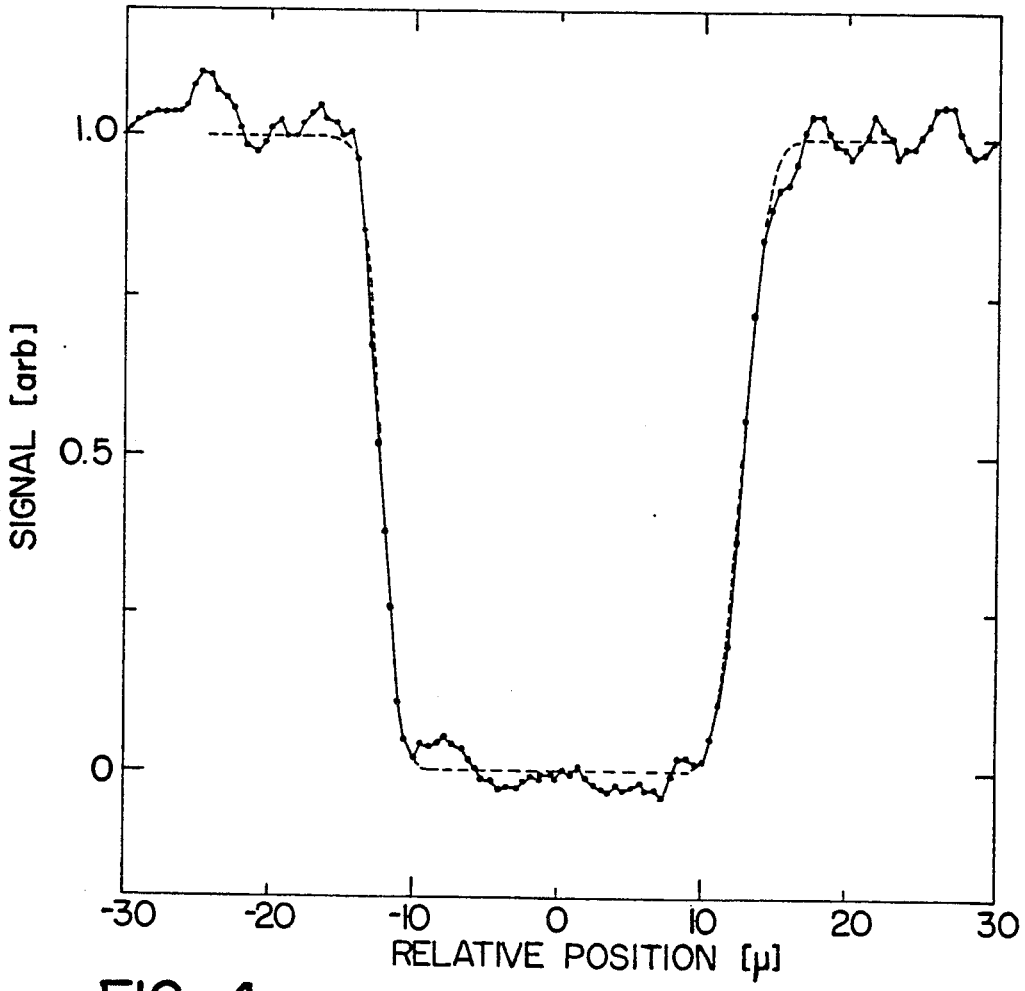
FIG. 4 is a graph showing a Raman-induced resonance image of the shadow cast in an atomic beam by a 25-μm wire.

For this experiment, a 25-$\mu$m-diameter gold-coated tungsten wire was placed at the center of the Raman fields, perpendicular to and at the center of the atomic beam. The shadow which is cast in the atomic beam is measured. The Raman-induced resonance image of the wire is shown in FIG. 4. The data points are connected by a solid line; the dashed line is the theoretical prediction for a spatial resolution of 1.7 $\mu$m. The signal detected is the fluorescence intensity in the final region vs. uniform magnetic field.

In this example, the known wire diameter confirms the gradient magnet calibration and the steepness of the rising edge of the fluorescence signal versus uniform field determines the experimental position resolution $\Delta x=1.7$ $\mu$m. This is consistent with the prediction of the optimum resolution, Equation (3), for a collimation half angle somewhat less than 1 mrad, and 0.4 $\mu$m of $(z^2)$-dependent position smearing.

EXAMPLE 3

Figure 5:
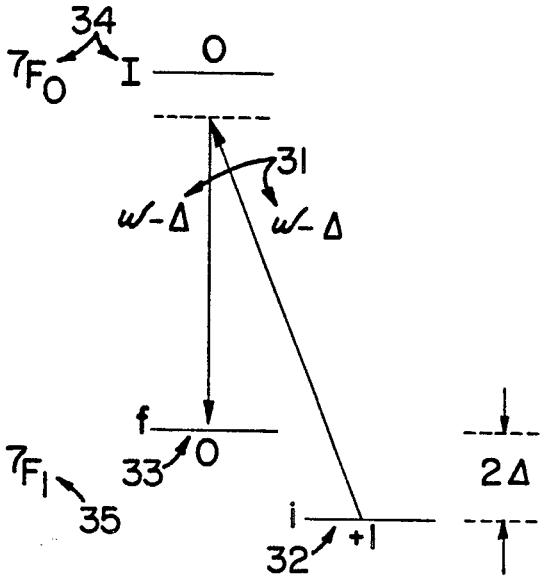
FIG. 5 is a schematic diagram of the energy levels of samarium ($^{152}Sm$) and the atomic transitions occurring in the present invention when the spatially varying potential is generated by a nonresonant intense laser field.

Raman-induced Resonance Imaging Using a Focussed Laser Field to Generate a Spatially Varying Potential This example demonstrates an apparatus for Raman induced resonance imaging, using a focussed laser field to generate a spatially varying potential. As seen schematically in FIG. 5, in this example Raman fields of frequencies $\omega\pm\Delta$ (31) induce transitions between the initial state i (32) and final state f (33). A spatially varying potential interacts with the f→I transition to shift the final state f, making the Raman transition frequency position dependent. The excited electronic state I (34) of $^{152}Sm$ is $^7F_0$, and $^7F_1$ (35) is the ground electronic state of $^{152}Sm$.

Atoms which are initially in the $m=+1$ sublevel of the $^7F_1$ ground state make a Raman transition to the $m=0$ sublevel via the $^7F_0$ excited state. The $m=0$ state, which is emptied prior to the Raman region by optical pumping, is detected after the Raman region by resonance fluorescence.

Figure 6:
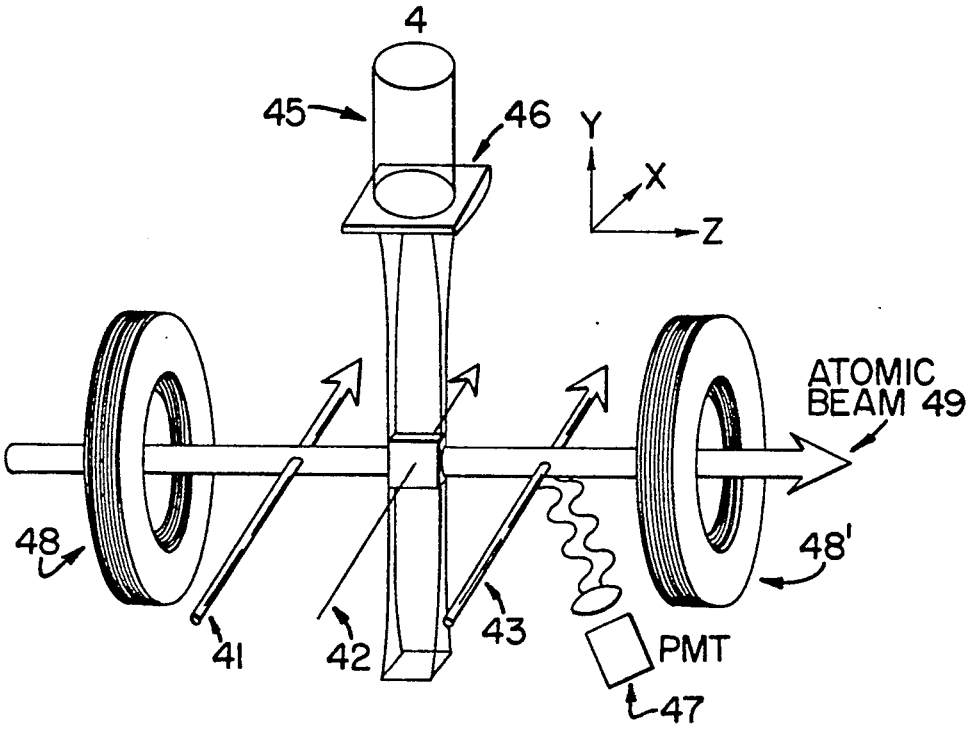
FIG. 6 is a diagram of an apparatus for carrying out a specific mode of the present invention using a focussed laser field to generate a nonresonant intense laser field and thus a spatially varying potential.

FIG. 6 is a diagram of the apparatus used to carry out the specific mode of the present invention used this example; it comprises an optical pump to empty the atomic beam of atoms at a predetermined final state; a Raman field to generate a transition between the initial and final state; a uniform magnetic field; a nonresonant intense laser field to generate a spatially varying potential, here comprising a focussed laser field; and a fluorescence detection device to detect the number of atoms at the predetermined final state. The uniform magnetic field is generated by two uniform field coils (48 and 48'). The first laser beam (41) with frequency $\omega$ empties the final atomic state. Atoms then enter the Raman region where two overlapping laser beams (42) of frequencies $\omega+\Delta$ and $\omega-\Delta$ cause transitions from the initial state to the final state in a localized region along the x axis. The light shifting beam (45) is focussed with a cylindrical lens (46) so that the intensity varies strongly along the x axis perpendicular to the atomic beam, causing the energy of the final state to be dependent on the position x. Atoms in the atomic beam (49) which emerge in the final state are detected by laser induced fluorescence using an additional laser beam (43) and a photo multiplier tube (PMT) (47) in the final region.

EXAMPLE 4

Measurement of a Localized Atomic Distribution Created by a Raman Region

This example demonstrates the use of a the apparatus described in Example 3 to measure a localized atomic distribution. The localized atomic distribution was created by a Raman region distinct from the Raman region of the apparatus that functions as the transition inducing field.

Figure 7:
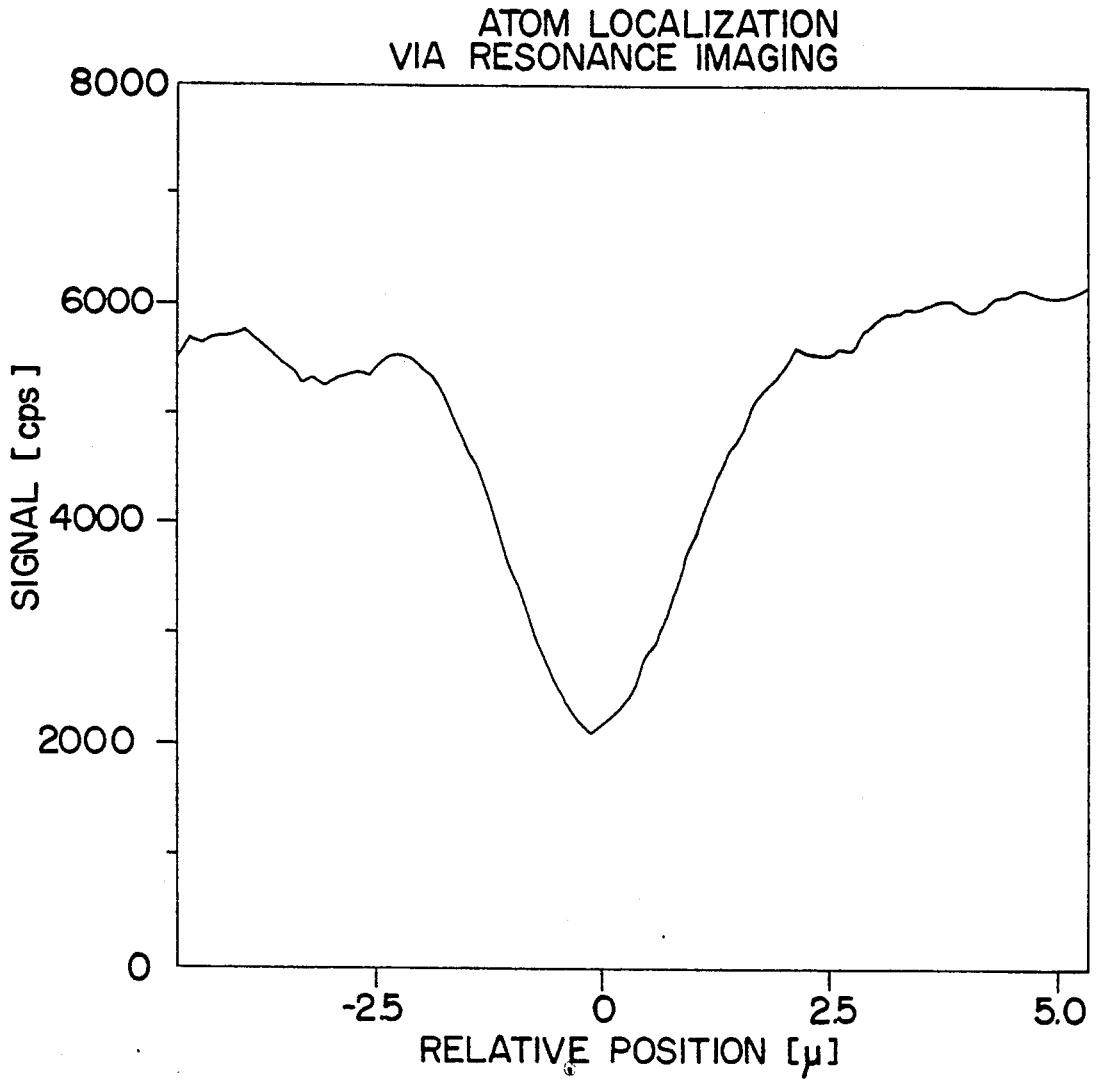
FIG. 7 is a graph showing the resonance image of a localized atomic distribution created by a Raman region and measured using the apparatus of FIG. 6.

FIG. 7 is the image of a localized atomic distribution created by a Raman region and measured using the arrangement of FIG. 6. Resolution shown is 0.9 μm. Best resolution obtained to date using this technique is 0.4 μm.

The foregoing examples are illustrative of the present invention, and are not to be construed as limiting thereof. The invention is defined by the following claims, with equivalents of the claims to be included therein.

That which is claimed is:

1. A method of measuring the position of atoms in an atomic beam, comprising:

(a) emptying an atomic beam of atoms in a predetermined detectable final state; then (b) passing the atomic beam through a transition inducing oscillating field having a frequency which induces atoms in the beam to make a transition from the initial atomic state to said detectable final atomic state while simultaneously passing the atomic beam through a spatially varying potential wherein the energy of the final atomic state of the atoms is dependent upon the position of the atoms in said spatially varying potential; then (c) detecting the number of atoms in said detectable final state; and then (d) repeating steps (b) and (c) with said transition inducing field having a different frequency at each repetition of (b) and (c) to generate a spectrum which corresponds to the position distribution of atoms in the atomic beam; wherein said spatially varying potential is generated by a nonresonant laser field.

2. The method of claim 1, wherein said spatially varying potential is generated by two nonresonant intersecting linearly polarized laser fields where the area of intersection encompasses the area to be measured.

3. The method of claim 2, wherein the difference between the energy of the final atomic state and the initial atomic state spatially varies in the range of from $10^{10}$ to $10^{13}$ Hz/cm.

4. The method of claim 1, wherein said transition inducing field comprises a Raman field.

5. The method of claim 1, wherein said transition inducing field comprises a single radio frequency field.

6. The method of claim 1, wherein said detecting step is selected from the group consisting of fluorescence detecting step, photon burst detecting step and photoionization detecting step.

7. The method of claim 1, wherein said emptying step is performed by optical pumping.

8. The method of claim 1, wherein said atomic beam is deposited upon a substrate after said detecting step.

9. An apparatus for measuring the position of atoms in an atomic beam, comprising:

(a) emptying means for emptying an atomic beam of atoms in a predetermined detectable final state; and (b) transition inducing means operatively associated with said emptying means, wherein the atomic beam is passed through a transition inducing field which induces transition of the atoms in the beam from the initial atomic state to the detectable final atomic state; and (c) means for generating a spatially varying potential simultaneously with the transition inducing field, wherein said spatially varying potential comprises a nonresonant laser field that varies in intensity across the atomic beam, and wherein the energy of the final atomic state of the atoms is dependent upon the position of the atoms in said nonresonant laser field; and (d) detecting means operatively associated with said transition inducing means and said spatially varying potential, for detecting the number of atoms in said detectable final state.

10. The apparatus of claim 9, wherein said means for generating a spatially varying potential comprises two nonresonant intersecting linearly polarized laser fields where the area of intersection encompasses the area to be measured.

11. The apparatus of claim 10, wherein said means for generating a spatially varying potential includes the use of a calcite wedge to create said intersecting laser fields.

12. The apparatus of claim 10, wherein said means for generating a spatially varying potential includes the use of at least one mirror to create said intersecting laser fields.

13. The apparatus of claim 9, wherein said means for generating a spatially varying potential comprises means for generating a focussed laser field.

14. The apparatus of claim 13, wherein said means for generating a focussed laser field includes a cylindrical lens yielding a laser beam having a focal diameter of from 1 to 100 μm in a direction perpendicular to the atomic beam and having a diameter of from 1 mm to 1 cm in a direction parallel to the atomic beam.

15. The apparatus of claim 9, wherein said means for generating a spatially varying potential creates a difference between the energy of the final atomic state and the initial atomic state that spatially varies in the range of from $10^{10}$ to $10^{13}$ Hz/cm.

16. The apparatus of claim 9, wherein said means for generating a transition inducing field comprises a Raman field.

17. The apparatus of claim 9, wherein said means for generating a transition inducing field comprises a single radio frequency.

18. The apparatus of claim 9, wherein the detecting means is selected from the group consisting of fluorescence detection means, photon burst detection means and photoionization detection means.

19. The apparatus of claim 9, wherein the emptying means comprises an optical pump.

20. The apparatus of claim 9, wherein control means operatively associated with said transition inducing means varies the frequency of said transition inducing field.

* * * * *

UNITED STATES PATENT AND TRADEMARK OFFICE

CERTIFICATE OF CORRECTION

PATENT NO. : 5,315,109

DATED : 24 May 1994

INVENTOR(S) : John E. Thomas

It is certified that error appears in the above-identified patent and that said Letters Patent is hereby corrected as shown below:

Column 3, line 56 , please correct " $h\Delta\omega$ " to read -- $\hbar\Delta\omega$ --.

Column 3, line 61, please correct " h/FT " to read -- $\hbar$/FT --.

Column 4, line 12, please correct " =h. " to read -- =$\hbar$. --.

Column 4, lines 25 & Equation 3, please correct " $hv_x$ " to read -- $\hbar v_x$ --.

Column 5, Formula, please correct " $h^2$ " to read -- $\hbar^2$ --.

Column 7, line 37, please correct " ] " to read -- $\pi$ --.

Signed and Sealed this

Sixth Day of September, 1994

*Attest:*

Bruce Lehman

BRUCE LEHMAN

*Attesting Officer*

*Commissioner of Patents and Trademarks*